US007187136B2

(12) United States Patent
Fiorello

(10) Patent No.: US 7,187,136 B2
(45) Date of Patent: Mar. 6, 2007

(54) METHOD AND CIRCUIT FOR REGULATING POWER IN A HIGH INTENSITY DISCHARGE LAMP

(75) Inventor: Ronald M. Fiorello, Tewksbury, MA (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/972,810

(22) Filed: Oct. 25, 2004

(65) Prior Publication Data

US 2006/0087259 A1 Apr. 27, 2006

(51) Int. Cl.
*H05B 37/00* (2006.01)

(52) U.S. Cl. ..... 315/224; 315/307

(58) Field of Classification Search ..... 315/224, 315/307; 323/222
See application file for complete search history.

(56) References Cited

U.S. PATENT DOCUMENTS 6,005,780 A 12/1999 Hua ..... 363/20
6,051,935 A * 4/2000 Bucks et al. ..... 315/224
6,118,673 A 9/2000 Hua ..... 363/21
6,204,614 B1 * 3/2001 Erhardt ..... 315/307
6,489,754 B2 * 12/2002 Blom ..... 323/222
6,570,366 B1 5/2003 Lin et al. ..... 323/207

* cited by examiner

*Primary Examiner*—David Vu
(74) *Attorney, Agent, or Firm*—Fitch, Even, Tabin & Flannery

(57) ABSTRACT

A circuit for controlling power to a high intensity discharge lamp is disclosed. The circuit according to one embodiment of the invention comprises a rectifier circuit coupled to receive an alternating current line voltage, and a boost/flyback converter coupled to the rectifier circuit which outputs a regulated DC bus voltage. A power control circuit also couples a feedback signal to the boost/flyback converter to regulate the power output of the boost/flyback converter. A method of controlling power to a high intensity discharge lamp is also disclosed. The method comprises steps of generating a DC voltage for the high intensity discharge lamp by way of a boost/flyback converter; monitoring the DC voltage and the current generated in the boost/flyback converter; and modifying the power output by the boost/flyback converter to regulate power based upon the voltage and the current.

2 Claims, 8 Drawing Sheets

METHOD AND CIRCUIT FOR REGULATING POWER IN A HIGH INTENSITY DISCHARGE LAMP

FIELD OF THE INVENTION

The present invention generally relates to circuits for powering discharge lamps, and more particularly to a circuit and method for regulating power in a high intensity discharge lamp.

BACKGROUND OF THE INVENTION

In starting a high intensity discharge (HID) lamp, the lamp experiences three phases. These phases include breakdown, glow discharge, and thermionic arc. Breakdown requires a high voltage to be applied between the electrodes of the lamp. Following breakdown, the voltage must be high enough to sustain a glow discharge and heat the electrode to thermionic emission. Once thermionic emission commences, current must be maintained in the run-up phase until the electrodes reach a steady-state temperature. After achieving the arc state, the lamp can be operated with a lower level of current in the steady state operating mode.

For ignition of the lamp, the lamp must be provided with a high voltage for a specified duration in the pre-breakdown period. Conventional lamps are characterized by a minimum voltage level and time duration in achieving breakdown. HID lamps require a high ignition voltage (e.g., 1000 to 5000 $V_{rms}$) to initiate the plasma discharge when cold. Lamp input power is typically 5–10 times higher during lamp ignition than the rated steady state lamp power because of high transient power losses. This voltage creates a high intensity electrical field applied to the electrodes that initiates the discharge. The high voltage requirements for breakdown can be achieved through pulse resonant circuits. The frequency at which the circuit achieves resonance and the resultant resonant voltage varies from circuit to circuit due to variation in component tolerances. Because lamp starting voltage depends on inverter input voltage, it is important that the DC bus voltage is maintained by keeping it in a definite range as long as possible before the lamp ignites. Once the arc has been established, it is beneficial to provide a constant power to the lamp to assure a constant and reliable light output.

Typically, electronic ballasts regulate lamp power when operating high intensity discharge lamps by sensing the lamp current and the lamp voltage. The sensed lamp current and voltage are multiplied to get the wattage. The multiplication can be achieved using a micro-controller or microprocessor. The wattage is then compared to a reference wattage. A feedback loop is provided in such a way that the error that results from this comparison is converted to a signal adjusting the lamp current so that the measured lamp power is equal to the reference power.

Prior art electronic ballasts for HID lamps receive an alternating line current, such as the alternating line current provided by a voltage source 10 as shown in FIG. 1. The current is provided to a rectifier circuit 12, which generates an output to a boost converter 14. The boost converter is typically controlled by a power factor correction controller 16. The output of the boost converter typically has it own voltage control loop to maintain its output voltage higher than the input voltage. The boost converter is followed by a power processing stage comprising a DC-DC converter 18, such as a buck converter or other suitable type of DC-DC converter, that again has its own control loop, such as a pulse width modulation (PWM) controller 20, and is used to maintain a constant voltage or current output and to perform the necessary voltage conversion and conditioning. The power processing stage is coupled to an inverter 22 (controlled by a corresponding inverter driver circuit 24) which delivers power to the lamp 26.

However, the additional power processing stage results in additional power losses and requires additional components which lead to increased size and higher cost. In manufacturing electronics generally, any reduction in the necessary parts can be significant. In the field of electronic ballasts, any improvement which can reduce material cost is significant. For example, the reduction or elimination of conventional circuitry can reduce part count and reduce cost significantly. Therefore, a need exists for a ballast that does not require a separate power processing stage in order to regulate the power that is supplied to an HID lamp.

OBJECTS OF THE INVENTION

It is an object of the present invention to provide a universal input voltage electronic ballast to reliably regulate lamp power via a single stage, single switch circuit, such as a combination boost and quasi-resonant Transition Mode (TM) flyback converter stage, which eliminates any need for an additional DC-DC converter power processing stage and avoids its associated energy losses, size, weight and cost.

It is a further object of the present invention to provide a microprocessor control circuit arrangement for programmable start of a universal voltage electronic ballast, such as a ballast having an active combination boost and quasi-resonant TM flyback, power regulated, power factor corrector and an inverter.

It is another object of the present invention to provide a microprocessor control circuit arrangement for programmable start of a universal voltage ballast utilizing a boost and quasi-resonant TM flyback converter for providing power factor correction and power regulation of an HID lamp.

It is another object of the present invention to provide a microprocessor control circuit arrangement for average power regulation and programmable start of universal voltage ballast utilizing a combination boost and quasi-resonant TM flyback converter by providing power regulated power factor correction to an inverter powering an HID lamp.

Accordingly, it is desirable to provide an improved electronic ballast for regulating power in a high intensity discharge lamp.

SUMMARY OF THE INVENTION

A circuit for controlling power to a high intensity discharge lamp is disclosed. The circuit according to one embodiment of the invention comprises a rectifier circuit coupled to receive an alternating current line voltage, and a boost/flyback converter coupled to the rectifier circuit which outputs a regulated DC bus voltage. A power control circuit also couples a feedback signal to the boost/flyback converter to regulate the power output by the boost/flyback converter.

A method of controlling power to a high intensity discharge lamp is also disclosed. The method comprises steps of generating a DC voltage for the high intensity discharge lamp by way of a boost/flyback converter; monitoring the DC voltage and the current generated in the boost/flyback converter; and modifying the power output by the boost/flyback converter to regulate power based upon the monitored voltage and current.

DETAILED DESCRIPTION OF THE PREFERRED EMBODIMENTS

The various embodiments of the present invention relate to an electronic ballast and method of controlling power to a high intensity discharge lamp by providing power factor correction, power regulation and AC-DC conversion in a single power processing stage. An electronic ballast is employed to power an HID lamp from a universal input AC line voltage. Average lamp power is regulated by a micro-controller driving a Transition Mode (TM) or critical conductance mode power factor controller. The ballast preferably includes an active power factor corrector circuit configured as combination boost and flyback converter. The output current and voltage of the combined boost and flyback converter are varied to regulate the lamp power. Either the DC output bus power can be regulated, or with the addition of a current and voltage transformer, the inverter AC output power can be regulated. Because the average is taken of a digital PWM output voltage based on a table lookup and is used to regulate the power of the combined boost and QR flyback converter, the need for an intermediate DC-DC converter stage and its associated cost and size are eliminated. Thus, the single stage, single switch boost and quasi-resonant (QR) flyback converter provides both power factor correction and load power regulation.

Figure 1:
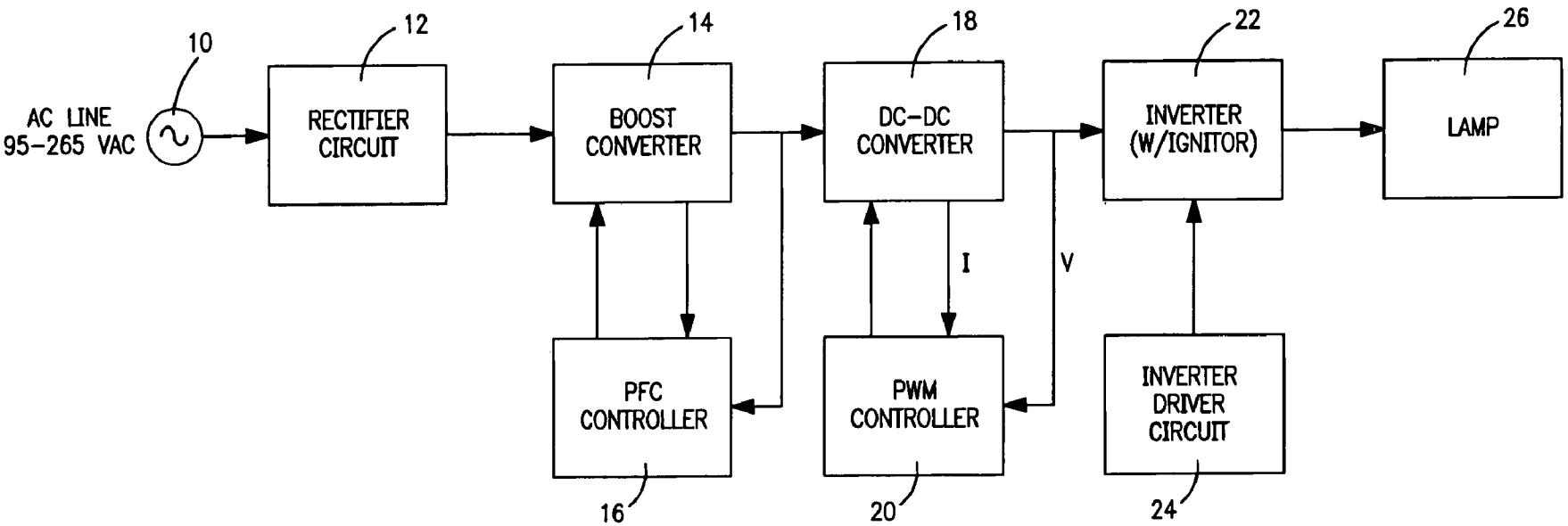
FIG. 1 PRIOR ART
FIG. 1 is a block diagram of a conventional circuit for powering a high intensity discharge lamp.
Figure 2:
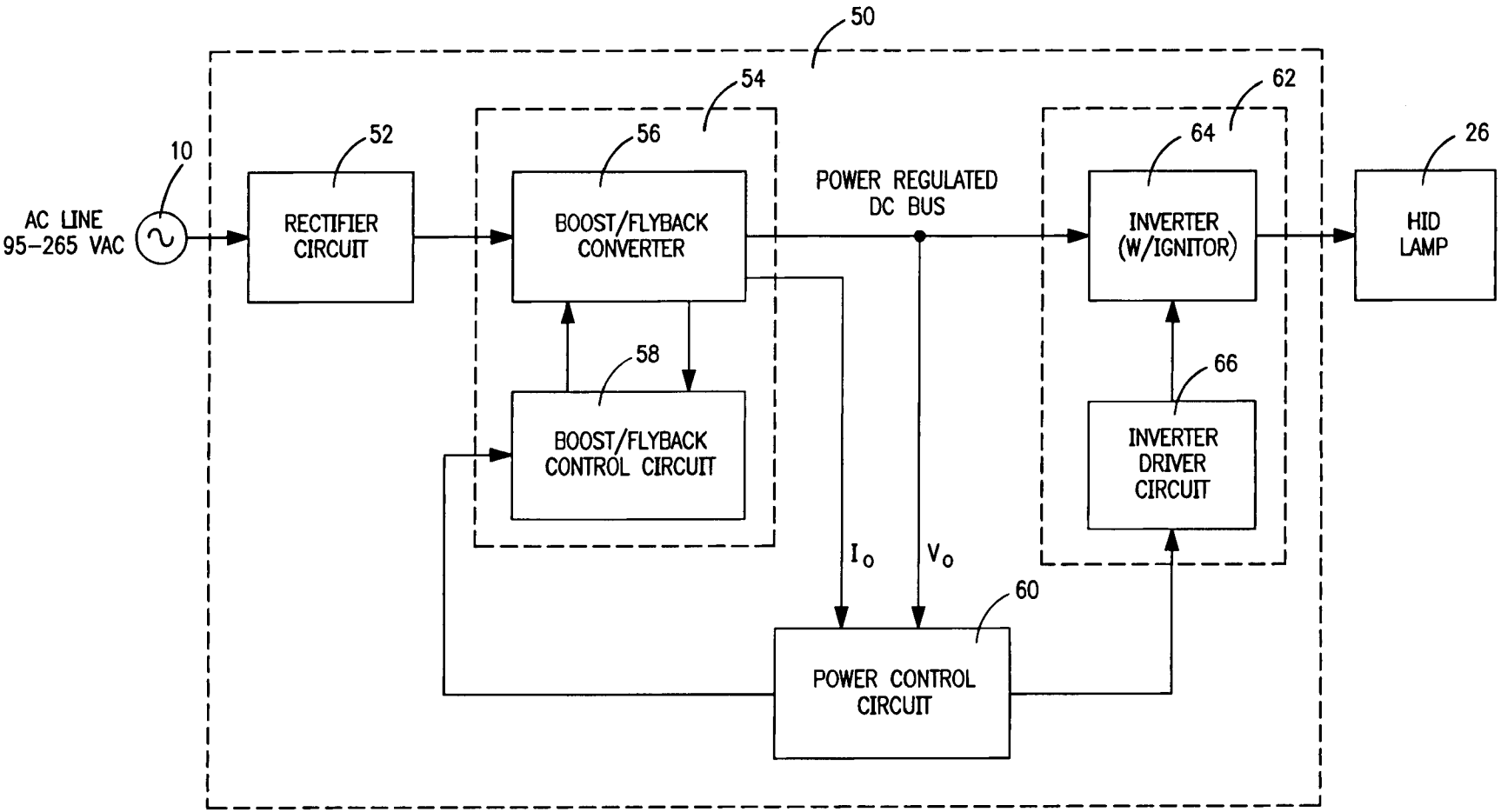
FIG. 2 is a block diagram of a circuit for powering a high intensity discharge lamp, according to an embodiment of the present invention.

A block diagram of circuit for powering a high intensity discharge lamp according to an embodiment of the present invention is shown in FIG. 2. The circuit may be used to regulate HID lamps powered from a source 10 such as a 120 or 277 V AC line, for example. In particular, an electronic ballast 50 for energizing an HID lamp 26 comprises a bridge rectifier circuit 52 coupled to an AC line source 10 and an active power factor corrector circuit 54. The active power factor corrector circuit 54 comprises a single stage, single switch converter configured as a combined boost and flyback converter 56 providing AC-DC conversion and a boost/flyback control circuit 58, providing power factor correction and power regulation in a single power processing stage. An inverter section 62 comprises an inverter circuit 64 having an igniter and receiving the output of the boost/flyback converter 56 by way of a power regulated DC bus, and an inverter driver circuit 66. As will be described in more detail below, the inverter circuit 64 provides the necessary voltage to ignite and power the HID lamp.

Figure 3:
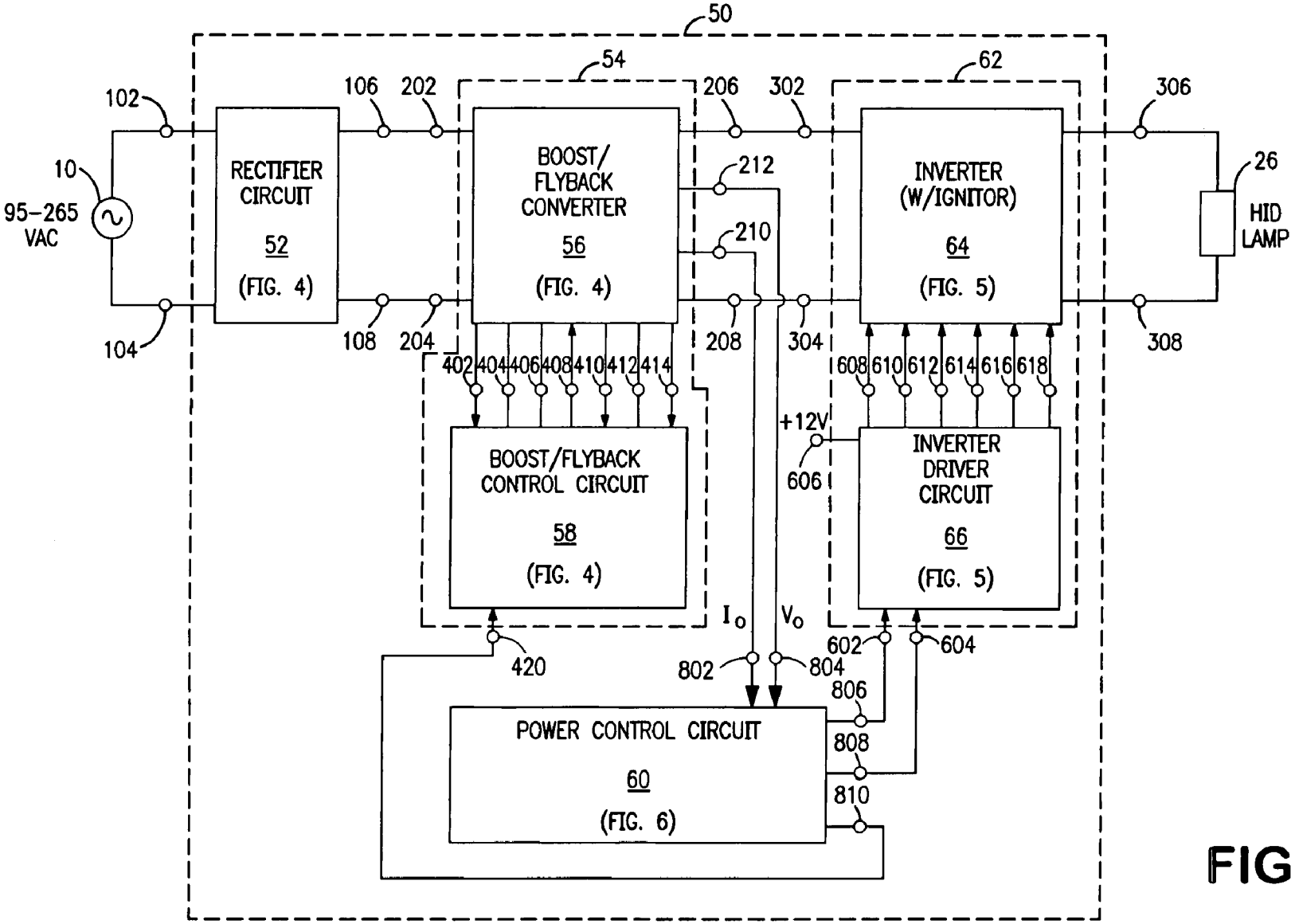
FIG. 3 is a more detailed block diagram of the circuit of FIG. 2, according to an embodiment of the present invention.
Figure 4:
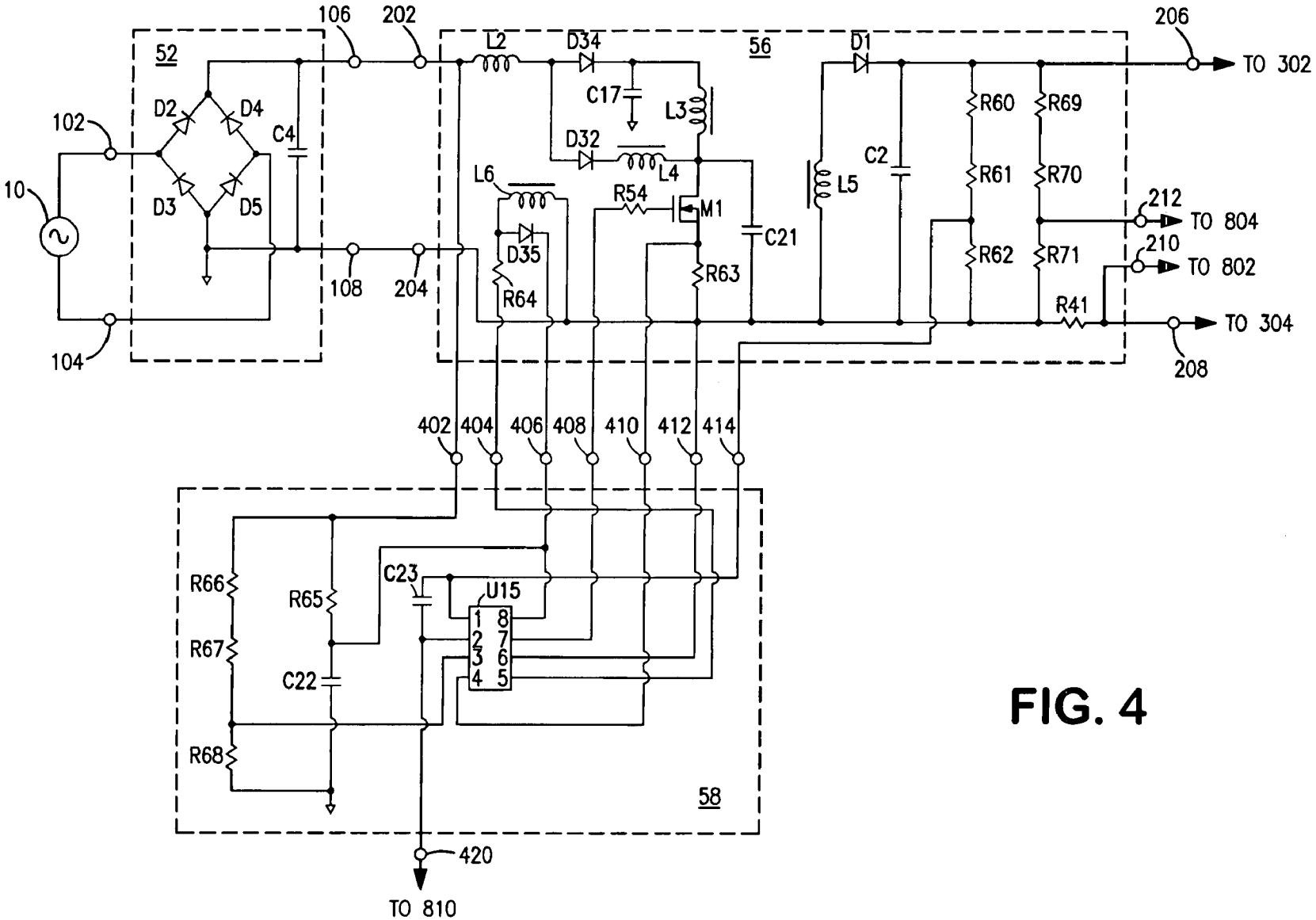
FIG. 4 is a detailed circuit diagram of a rectifier circuit, a boost/flyback converter, and a boost/flyback control circuit, according to an embodiment of the present invention.
Figure 5:
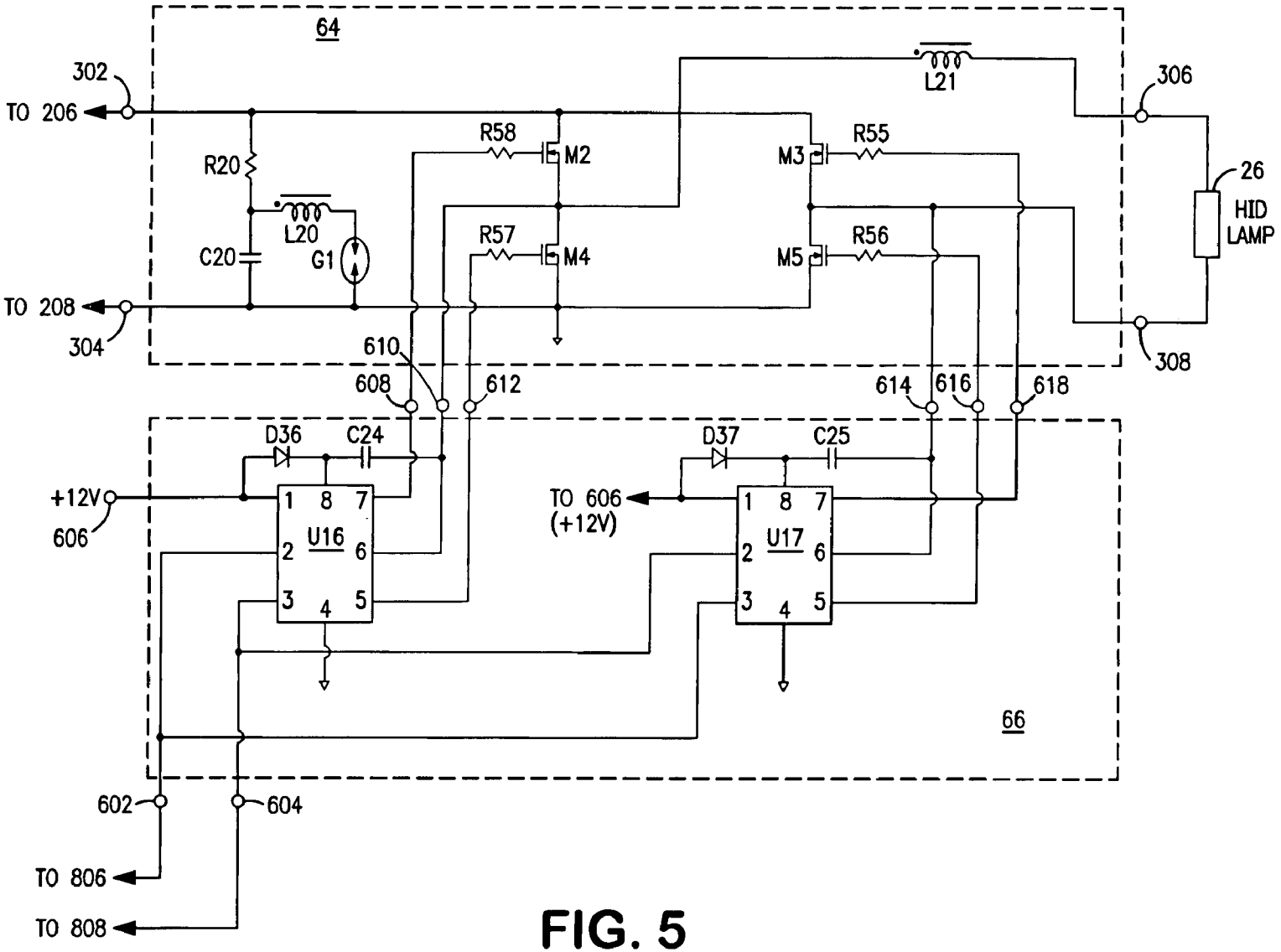
FIG. 5 is a detailed circuit diagram of an inverter and an inverter driver circuit, according to an embodiment of the present invention.
Figure 6:
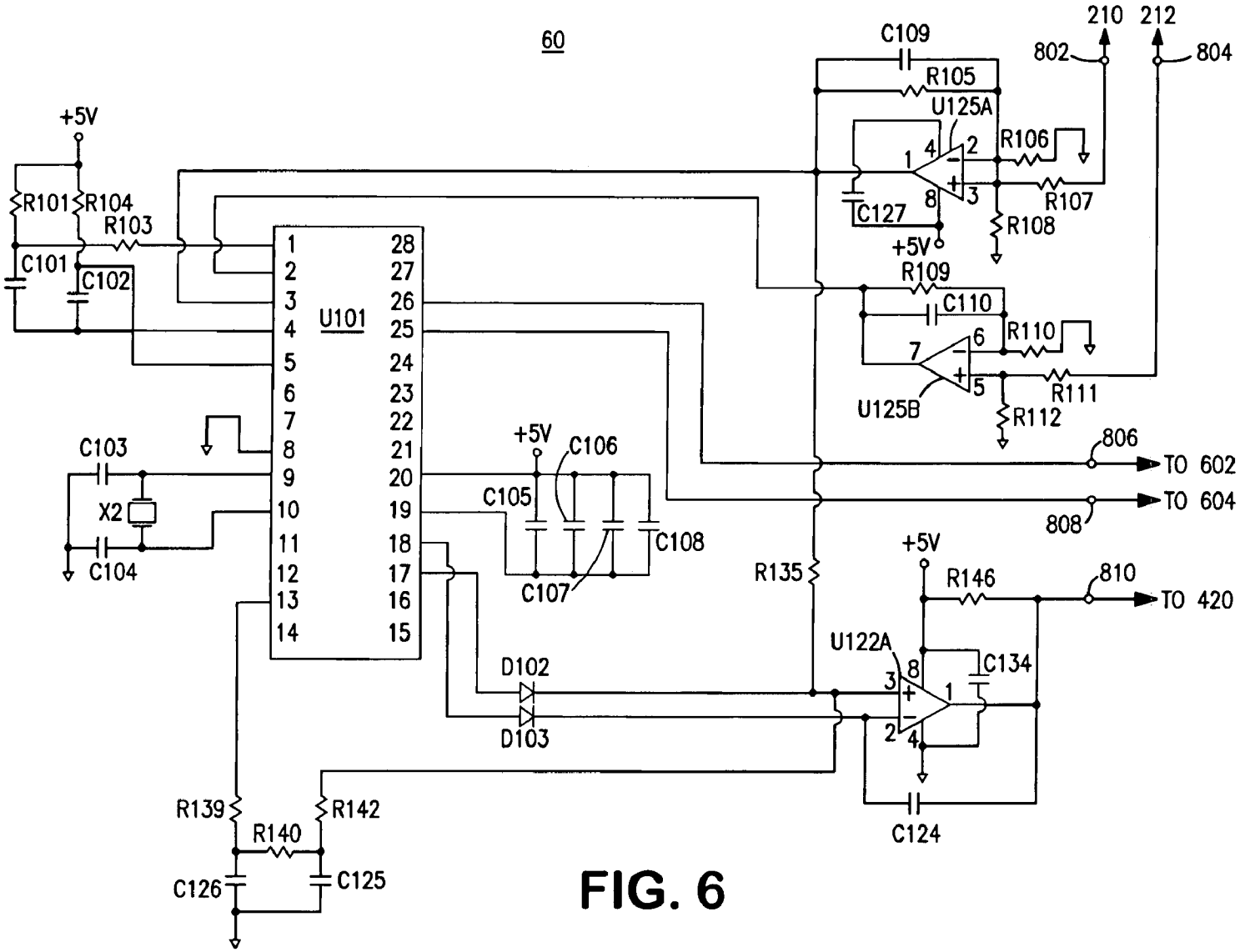
FIG. 6 is a detailed circuit diagram of a power control circuit, according to an embodiment of the present invention.

A single loop power regulation method according to an embodiment of the present invention is employed to maintain constant power to the lamp. The various connections between the circuits of FIGS. 4–6 are shown in more detail in FIG. 3 to enable an understanding of the interaction between the various circuits. As will be described in more detail in reference to FIG. 4, the power factor corrector circuit 54 feeds an inverter to provide AC excitation to drive an HID lamp. The inverter 64 and the inverter driver circuit 66 will be described in more detail in reference to FIG. 5. Finally, the power control circuit 60 detects the current and voltage output by the boost/flyback converter 56, as will be described in more detail in reference to FIG. 6.

Turning now to FIG. 4, a circuit diagram of the active power factor correction circuit according to an embodiment of the present invention is shown. The circuit, which is generally an AC to DC converter section, comprises a rectifier circuit 52 having diodes D2–D5 and a capacitor C4 coupled across the output of the rectifier circuit 52. The combined boost and flyback converter 56 coupled to the rectifier circuit comprises a boost inductor L2. A flyback transformer coupled to the boost inductor comprises windings L3–L6, and a boost diode D34. A capacitor C17 is coupled between the L3 winding and ground. A power switching transistor M1 is driven via an input resistor R54 to periodically energize the boost inductor L2 and flyback transformer inductor L3 from a rectified voltage. An output rectifier diode D1 is connected to the secondary winding L5 of the flyback transformer. An output energy storage capacitor C2 is coupled across the output of the combined boost and flyback circuit. According to one embodiment of the present invention, the windings of the boost inductor and flyback transformer are configured such that L2 has an inductance of 150 uH with 25 turns wound on a TDK PQ35/35 core (gapped), the L3 to L5 turn ratio is 1 to 0.65, where L3 has 30 turns, the L3 to L4 turn ratio is 1 to 0.3, the L3 to L6 turn ratio (zero current winding) is 1 to 0.15, and L3, L4, L5, and L6 are wound on TDK PQ40/40 cores. The quasi-resonant flyback section of the power factor corrector circuit preferably operates in the critical conduction mode to minimize switching losses, and incorporates a Transition Mode controller regulating a constant output power via a micro-controller commanded reference.

The combined boost and flyback converter 56 is also coupled to the boost/flyback control circuit 58 which comprises a power factor controller circuit having a power factor controller U15, such as an SGS Microelectronics L6561™ controller. The power factor controller U15 is provided with a voltage feedback loop through a resistor divider R60–R62, a current feed back loop through resistor R63, and a power regulation loop. The resistor divider network comprising resistors R60, R61 and R62 generates a feedback voltage associated with the open-circuit output of the boost/flyback converter 56. A second resistor network comprising resistors R69, R70, R71 and R41 generates a feedback current signal at output 210 and a feedback voltage signal at output 212. As will be described in more detail with reference to FIG. 6, the feedback voltage and feedback current signals are coupled to the power control circuit 60 to generate a power control signal which is fed back by way of a power control loop to the power factor controller U15. Based upon the value of the power control signal, the power factor controller regulates the power of the combined boost and flyback circuit 56 by controlling the frequency and the duty cycle at which transistor M1 is driven.

The AC to DC converter section shapes the sinusoidal input current to be in phase with sinusoidal input voltage and regulates the output power of the combined boost and flyback circuit through the power command control loop coupled to the power transistor M1 by way of a resistor R54. The power factor controller circuit U15 is preferably provided with a peak current sense feature for zero current turn-on and near zero voltage turn-off of the power transistor M1. Finally, a resistor/capacitor (RC) network provides voltage values at various locations of the boost/flyback converter 56 to power factor controller U15. In particular, a resistor network comprising resistors R66, R67 and R68 provides the voltage at the input of the boost/flyback converter to the power factor controller U15. A resistor/capacitor circuit comprising R65 and C22 is coupled to the rectifier circuit output 106,108 and generates a bias during start-up of the lamp to provide an auxiliary supply to U15 until the lamp lights. According to one embodiment of the invention, M1 is a IXS24N100 24A/1000V power transistor from IXYS Corporation. R41 is a 2 W, 5% resistor comprising four 0.62 ohm resistors in parallel. D1, D32, D34 are 8A/600V diodes from IXYS Corporation. Finally, D35 is a 1N4148 diode from Philips Semiconductors. The remaining capacitors, resistors and diodes preferably have the following values set forth in Table 1.

TABLE 1

| Component | Value |
|---|---|
| C4 | .22 uf/500 V |
| C17 | 560 uF/350 V |
| C2 | 1 uF/400 V |
| C23 | 1 uF/50 V |
| C22 | 22 uF/50 V |
| C21 | 2200 pF/1k V |
| D2, 3, 4, 5 | 3 A/600 V |
| R54 | 22 ohms |
| R63 | .15 ohms |
| R64 | 34k ohms |
| R60, 61 | 124k ohms |
| R62 | 2.49k ohms |
| R66, 67 | 750k ohms |
| R68 | 9.1k ohms |
| R65 | 150k ohms |
| R69, 70 | 250k ohms |
| R71 | 5k ohms |

Turning now to FIG. 5, a circuit diagram of the inverter 64 and the inverter driver circuit 66 according to an embodiment of the present invention is shown. Inverter 64 preferably includes a typical igniter circuit comprising a resistor R20, a capacitor C20, an inductor L20–L21, and a spark gap generator G1. The igniter circuit is coupled across the lamp to ignite the lamp, as is well known in the art. Inverter driver circuit 66 includes gate drivers U16 and U17, each of which preferably comprises an IR2101 gate driver from International Rectifier. The gate drivers U16 and U17 control transistors M2 and M4 and transistors M3 and M5, respectively, which comprise an H bridge converter for converting the DC voltage generated by the combined boost and flyback converter 56 to an AC voltage. Preferably, transistors M2, M3, M4, and M5 are 12A/600V transistors, such as 20N60S transistors from Infineon Corporation. Capacitors C24 and C25 are 1 uF/50V capacitors, diodes D36 and D37 are 1A/600V diodes, and resistors R55–58 are 22 ohm resistors.

Turning now to FIG. 6, a block diagram of a power control circuit according to an embodiment of the present invention is shown. The power control circuit 60 preferably comprises a microprocessor U101, such as a Microchip PIC 18C242 or similar microcontroller, and includes a first input terminal 802 for monitoring the output current (via resistor R41 of FIG. 4) of the boost/flyback converter, and a second input terminal 804 for monitoring the DC bus voltage (via resistive divider R69, R70, R71 of FIG. 4) at the output of the boost/flyback converter. The first input terminal 802 is coupled to a differential OP-AMP U125A, gain setting resistors R105, R106, R107, R108, and frequency compensation capacitor C109. The first input terminal enables a single stage, single switch power factor corrected AC-DC converter and constant average lamp power that is scalable to other power levels via the proper adjustment of R105, R106, R107 and R108 or via a change in look-up table ROM values. The second input terminal 804 is coupled to OP-AMP U125B, gain setting resistors R109, R110, R111, R112, and frequency compensation capacitor C110. The output of the microprocessor U101 is coupled to a current amplifier comprising OP-AMP U122A. In particular, U122A is driven by U101 by way of diodes D102 and D103, which are preferably 1N4148 diodes, until the lamp lights, when the power regulation circuit takes over. An associated low pass filter comprising R139, C126, R140 and C125 is also coupled to the other input of OP-AMP 122A to provide power regulation. The duty cycle of the signal at pin 13 of U101, which is based upon the output voltage at the output of U125B coupled to pin 2 of U101, is based upon the values in a lookup table as depicted in Table 2 below.

TABLE 2

| Output Voltage | Duty Cycle |
|---|---|
| 1.310484 | 0.66129 |
| 1.315249 | 0.65927 |
| 1.320015 | 0.65726 |
| 1.324780 | 0.65524 |
| 1.329545 | 0.65323 |
| 1.334311 | 0.64919 |
| 1.339076 | 0.64718 |
| 1.343842 | 0.64516 |
| 1.348607 | 0.64315 |
| 1.353372 | 0.64113 |
| 1.358138 | 0.63911 |
| 1.362903 | 0.63710 |
| 1.367669 | 0.63508 |
| 1.372434 | 0.63105 |

The low pass filter couples an average value voltage to pin 3 of U122A. The output of the OP-AMP 122A is fed back (via output 810) to the boost/flyback control circuit 58, which controls the frequency and duty cycle at which transistor M1 is driven based upon the value of the output of OP-AMP 122A. That is, the output of OP-AMP 122A comprises a power control signal which controls the power generated by the combined boost and flyback converter.

It should be noted that the lamp current and voltage which are used to regulate the lamp power are monitored by microprocessor U101 (FIG. 6) to detect any fault conditions that may occur. If a fault condition does occur, the microprocessor sends a command (by way of diode D102, OP-AMP U122A, and output 810) to effectuate shutdown of the boost/flyback converter, thus providing protection for the ballast electronics. Preferably, the resistors and capacitors in the circuit of FIG. 6 have the following values: R11,103, 104=1 k ohm, R105,108=25 kohm, R106,107,110,111,139, 140=10 kohm, R109,112=39.2 kohm, R133=40 kohm, R142,146=5 k ohm, C11,102,124,125,126,134,139=1 uF, C103,104=18 pF, C109,110=470 pF.

Figure 7:
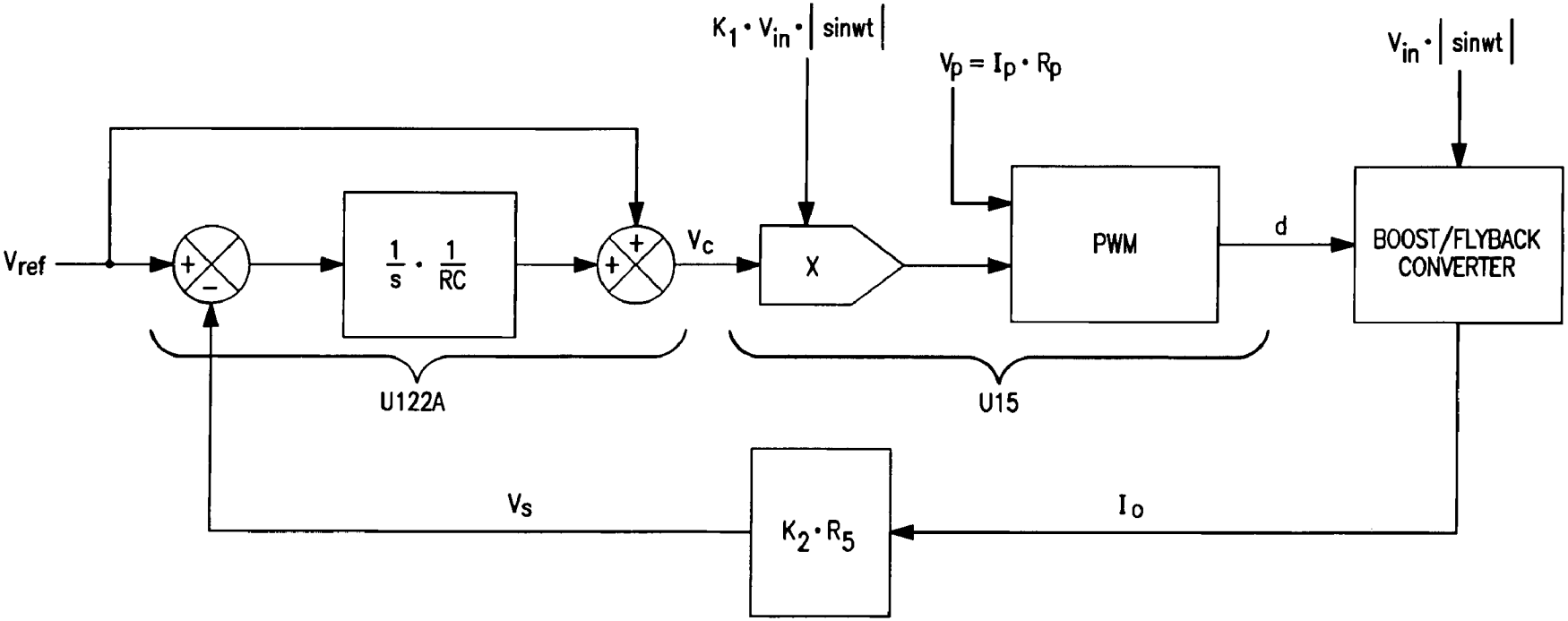
FIG. 7 is a diagram that describes a power regulation control loop, according to an embodiment of the present invention.

Turning now to FIG. 7, a block diagram describes a power regulation control loop and the shaping of a sinusoidal input current according to an embodiment of the present invention is shown. An embedded micro-controller, such as U101 of FIG. 6, measures lamp power by sampling lamp voltage and current. The voltage is used as an index into a look-up table to determine the appropriate current command to arrive at the correct lamp power. The micro-controller provides a digital pulse width modulated output whose duty ratio is proportional to the measured lamp voltage. This signal is then averaged and used as the reference for the current error amplifier, for example OP-AMP 122A of FIG. 6. That is, the summer blocks and error amplification could be performed by OP-AMP 122A which receives $V_{ref}$ at pin 3 and outputs a power control signal $V_c$ representing an error signal. The output $V_c$ of this error amplifier is used instead of the error amplifier internal to a power factor controller as a variable input to the multiplier. This input is multiplied by a sample of the rectified line voltage to provide a rectified AC reference. The reference is compared to the power switch current to shape sinusoidal input current such that the input current is $I_{in}$=K*sin wt, where K is the variable DC term controlled by the power control loop. The multiplication and pulse width modulation is performed by the power factor controller U15, which receives the sensed peak voltage $V_p$ and outputs a duty cycle signal "d" coupled to the combined boost and flyback converter. The output current $I_o$ is then modified by an amplification factor $K_2$ to generate a voltage input Vs to U122A. The power factor controller error amplifier provides a regulated open circuit bus voltage of approximately 300VDC before lamp ignition is initiated. Once lamp ignition has occurred, the power regulation loop controls and regulates lamp power based on a lookup table stored in onboard program ROM.

Figure 8:
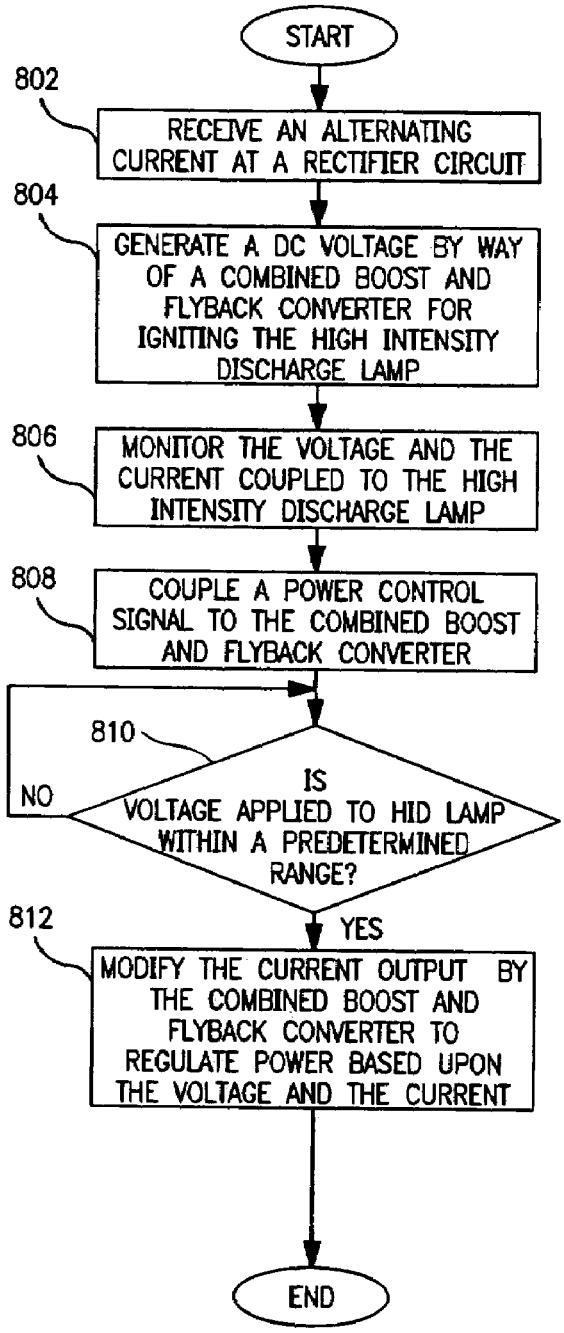
FIG. 8 is a flow diagram showing a method for controlling power to a high intensity discharge lamp, according to an embodiment of the present invention.

Turning now to FIG. 8, a flow diagram shows a method for controlling power to a high intensity discharge lamp according to an embodiment of the present invention. In particular, an alternating current is received at a rectifier circuit at a step 802. A DC voltage is generated by way of a combined boost and flyback converter for igniting the high intensity discharge lamp at a step 804. The voltage and the current coupled to the high intensity discharge lamp are monitored at a step 806. A power control signal is coupled to the combined boost and flyback converter at a step 808. It is then determined whether the voltage applied to HID lamp is within a predetermined range at a step 810. The current output by the combined boost and flyback converter is then modified to regulate power based upon the voltage and the current at a step 812. The frequency and/or duty cycle of a power transistor of the combined boost and flyback circuit can be modified to regulate the output power.

Figure 9:
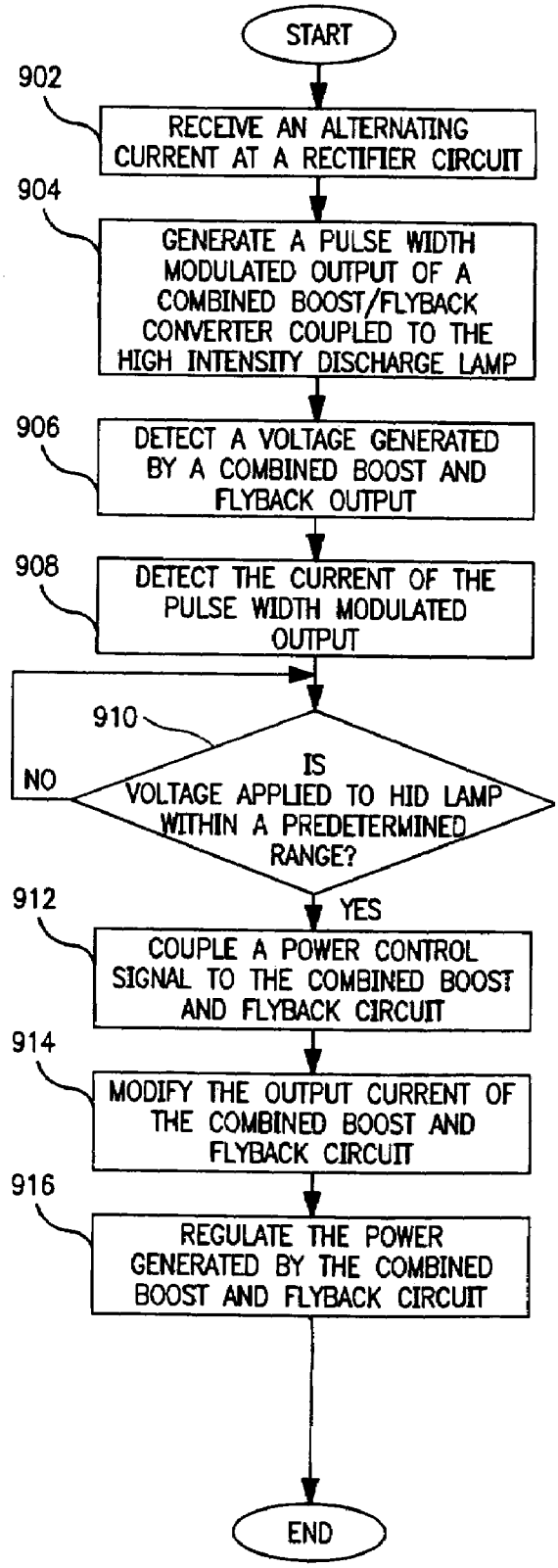
FIG. 9 is a flow diagram showing a method for controlling power to a high intensity discharge lamp, according to an alternate embodiment the present invention.

Turning now to FIG. 9, a flow diagram shows a method for controlling power to a high intensity discharge lamp according to an alternate embodiment the present invention. An alternating current is received at a rectifier circuit at a step 902. A pulse width modulated output of a boost converter coupled to the high intensity discharge lamp is generated at a step 904 in order to ignite the lamp. A voltage generated by the boost converter is detected at a step 906. The current of the pulse width modulated output is detected at a step 908. It is then determined whether the voltage applied to HID lamp is within a predetermined range at a step 910. A power control signal is coupled to the boost converter at a step 912. The output current of the boost converter is modified at a step 914, and the power generated by the boost converter is regulated at a step 916. That is, the frequency and/or duty cycle of a power transistor of the combined boost and flyback circuit can be modified to regulate the output power.

It can therefore be appreciated that the new and novel circuit for and method of controlling power to a high intensity discharge lamp has been described. It will be appreciated by those skilled in the art that numerous alternatives and equivalents will be seen to exist which incorporate the disclosed invention. As a result, the invention is not to be limited by the foregoing embodiments, but only by the following claims.

The invention claimed is:

1. A ballast for powering a high intensity discharge lamp, comprising:

a rectifier circuit adapted to receive an alternating current line voltage;

an active power factor corrector (PFC) circuit coupled to the rectifier circuit, and operable to provide an output current and an output voltage;

an inverter section coupled to the active PFC circuit;

a power control circuit means for providing a power control signal to the active PFC circuit in dependence on the output voltage and the output current of the active PFC circuit, wherein the power control circuit means is coupled between the inverter section and the active PFC circuit; and wherein the active PFC circuit comprises:

a boost/flyback converter coupled between the rectifier circuit and the inverter section; and a boost/flyback control circuit means for controlling operation of the boost/flyback converter in dependence on the power control signal provided by the power control circuit means, wherein the boost/flyback control circuit means is coupled between the boost/flyback converter and the power control circuit means.

2. A ballast for powering a high intensity discharge lamp, comprising:

a rectifier circuit adapted to receive an alternating current line voltage;

an active power factor corrector (PFC) circuit coupled to the rectifier circuit, and operable to provide an output current and an output voltage;

an inverter section coupled to the active PFC circuit;

a power control circuit means for providing a power control signal to the active PFC circuit in dependence on the output voltage and the output current of the active PFC circuit, wherein the power control circuit means is coupled between the inverter section and the active PFC circuit; and wherein the active PFC circuit comprises:

a boost/flyback converter means for providing the output voltage and the output current of the active PFC circuit, wherein the boost/flyback converter means is coupled between the rectifier circuit and the inverter section; and a boost/flyback control circuit means for controlling the boost/flyback converter means in dependence on the power control signal provided by the power control circuit means, wherein the boost/flyback control circuit means is coupled between the boost/flyback converter means and the power control circuit means.

* * * * *